US007172351B2

(12) United States Patent
Kawaguchi

(10) Patent No.: US 7,172,351 B2
(45) Date of Patent: Feb. 6, 2007

(54) METHOD FOR MANUFACTURING AN ARMATURE

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 422 days.

(21) Appl. No.: 10/764,642

(22) Filed: Jan. 26, 2004

(65) Prior Publication Data

US 2005/0160576 A1 Jul. 28, 2005

(51) Int. Cl.
*B41J 2/275* (2006.01)

(52) U.S. Cl. ..... 400/124.23; 29/620; 29/609; 400/124.18; 101/93.04

(58) Field of Classification Search ..... 29/602.1, 29/506–598, 825–831; 400/124.23, 124.12; 101/93.01

See application file for complete search history.

(56) References Cited

U.S. PATENT DOCUMENTS

| | | | | |
|---|---|---|---|---|
| 3,804,224 | A | 4/1974 | Barnaby et al. | |
| 4,537,520 | A | 8/1985 | Ochiai et al. | |
| 4,552,064 | A | 11/1985 | Sanders, Jr. et al. | |
| 4,674,896 | A | 6/1987 | Yasunaga et al. | |
| 4,697,939 | A | 10/1987 | Ara | |
| 4,767,227 | A | 8/1988 | Mitsuishi et al. | |
| 4,802,776 | A * | 2/1989 | Miyazawa et al. | 400/124.2 |
| 4,881,832 | A | 11/1989 | Mitsuishi et al. | |
| 4,988,223 | A | 1/1991 | Hilkenmeier et al. | |
| 4,993,854 | A | 2/1991 | Sato | |
| 5,074,687 | A | 12/1991 | Gugel | |
| 5,137,377 | A | 8/1992 | Ito et al. | |
| 5,205,659 | A | 4/1993 | Gugel et al. | |
| 5,290,112 | A | 3/1994 | Stempfle et al. | |
| 5,674,014 | A | 10/1997 | Jordan | |
| 5,975,776 | A * | 11/1999 | Groenke | 400/124.21 |
| 6,513,997 | B2 | 2/2003 | Terao | |
| 6,682,233 | B2 | 1/2004 | Terao | |
| 6,698,956 | B1 | 3/2004 | Terao et al. | |
| 6,776,545 | B1 | 8/2004 | Terao | |
| 6,805,503 | B1 | 10/2004 | Tsuchiya et al. | |

(Continued)

FOREIGN PATENT DOCUMENTS

JP 02-011336 A 1/1990

(Continued)

OTHER PUBLICATIONS

Related U.S. Appl. No. 11/246,639, filed Oct. 7, 2005; Inventor: T. Kawaguchi.

(Continued)

*Primary Examiner*—Minh Trinh
(74) *Attorney, Agent, or Firm*—Frishauf, Holtz, Goodman & Chick, P.C.

(57) ABSTRACT

An armature manufacturing method of forming an armature including an arm holding a printing wire, and magnetic circuit forming members attached to the arm places the magnetic circuit forming members on the arm with a resistive layer of a resistive material having high electric resistance sandwiched between the arm and each of the magnetic circuit forming members, and welds together the arm and the magnetic circuit forming members with the resistive films sandwiched between the arm and the magnetic circuit forming members by spot welding. The arm and the magnetic circuit forming members of the armature can be joined together by welds having a high weld strength.

9 Claims, 5 Drawing Sheets

U.S. PATENT DOCUMENTS

| | | | |
|---|---|---|---|
| 6,848,843 | B1 | 2/2005 | Kawaguchi |
| 6,872,016 | B2 | 3/2005 | Kawaguchi |
| 6,994,482 | B2 | 2/2006 | Terao et al. |
| 7,008,126 | B2 | 3/2006 | Kawaguchi |
| 7,018,116 | B2 | 3/2006 | Tsuchiya et al. |
| 7,020,023 | B2 | 3/2006 | Kuramori |
| 7,048,455 | B2 | 5/2006 | Kawaguchi et al. |
| 2004/0170461 | A1 | 9/2004 | Kawaguchi |
| 2005/0058488 | A1 | 3/2005 | Kawaguchi |
| 2005/0160576 | A1 | 7/2005 | Kawaguchi |
| 2005/0201797 | A1 | 9/2005 | Kawaguchi et al. |
| 2005/0201798 | A1 | 9/2005 | Kawaguchi et al. |
| 2005/0201799 | A1 | 9/2005 | Tsuchiya et al. |
| 2005/0201800 | A1 | 9/2005 | Tsuchiya et al. |
| 2005/0201801 | A1 | 9/2005 | Kawaguchi et al. |
| 2005/0207814 | A1 | 9/2005 | Kawaguchi |
| 2005/0207815 | A1 | 9/2005 | Terao et al. |
| 2005/0214052 | A1 | 9/2005 | Kawaguchi et al. |
| 2006/0029449 | A1 | 2/2006 | Kawaguchi |
| 2006/0104696 | A1 | 5/2006 | Kawaguchi |

FOREIGN PATENT DOCUMENTS

| | | | |
|---|---|---|---|
| JP | 3-007351 | A | 1/1991 |
| JP | 3-39256 | A | 2/1991 |
| JP | 03-191036 | A | 8/1991 |
| JP | 3-288660 | A | 12/1991 |
| JP | 4-002639 | A | 1/1992 |
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 7-22994 | B2 | 3/1995 |
| JP | 07-125265 | A | 5/1995 |
| JP | 09-187972 | A | 7/1997 |
| JP | 9-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |

OTHER PUBLICATIONS

Related U.S. Appl. No. 11/301,412, filed Dec. 13, 2005; Inventor: T. Kawaguchi.

U.S. Appl. No. 11/073,118, Inventor: Kawaguchi et al., filed Mar. 3, 2005.

U.S. Appl. No. 11/073,117, Inventor: Tsuchiya et al., filed Mar. 3, 2005.

U.S. Appl. No. 11/073,092, Inventor: Kawaguchi et al., filed Mar. 3, 2005.

U.S. Appl. No. 11/073,093, Inventor: Kawaguchi et al., filed Mar. 3, 2005.

U.S. Appl. No. 10/655,894, Inventor: Kawaguchi,T., filed Sep. 4, 2003.

U.S. Appl. No. 10/655,281, Inventor: Kawaguchi,T., filed Sep. 3, 2004.

U.S. Appl. No. 10/940,361, Inventor: Kawaguchi, T. et al,. filed Sep. 14, 2004.

U.S. Appl. No. 10/940,362, Inventor: Kawaguchi, T. et al,. filed Sep. 14, 2004.

U.S. Appl. No. 10/940,492, Inventor: Tsuchiya, K. et al,. filed Sep. 14, 2004.

U.S. Appl. No. 10/940,432, Inventor: Kawaguchi, T. filed Sep. 14, 2004.

U.S. Appl. No. 10/940,338, Inventor: Kawaguchi, T. et al,. filed Sep. 14, 2004.

* cited by examiner

| | Welding current (A) | Pressure (kgf) | Size of electrodes (mm) | Waveform of welding current | Weld strength (kgf·cm) |
|---|---|---|---|---|---|
| Example | 3600 | 24 | 4X6 | 1+7+5+9+2 | 5.8 |
| Comparative example | 3750 | 24 | 4X6 | 1+7+5+9+6 | 5.5 |

METHOD FOR MANUFACTURING AN ARMATURE

BACKGROUND OF THE INVENTION

1. Field of the Invention

The present invention relates to a method for manufacturing an armature used in print heads in wire dot matrix printers.

2. Discussion of the Background

In a print head in a wire dot matrix printer, an armature connected to printing wires is turned between a printing position and a waiting position. When the armature is turned to the printing position the tips of the wires strike a printing medium such as paper to perform printing. Print heads of this type wire dot matrix printer contain a coil that generates a magnetic flux around an armature to form a magnetic circuit capable of attracting the armature from the waiting position to the printing position.

The armature includes an arm and magnetic circuit forming members attached to both side surfaces in the thickness direction of the arm. A printing wire is attached to the arm by brazing. The magnetic circuit forming members are attached to the arm by a method such as spot welding. Technology for welding an armature to another member is disclosed in JP-U 35288/1993 and JP-A 314868/1997. Technology for welding three members together is disclosed in JP-B 22994/1995.

The arm and magnetic circuit forming members are in most cases plated to prevent corrosion and to improve capability for brazing. The strength of the joint between the arm and magnetic circuit forming members welded to the arm therefore weakens due to the plating and the nugget region becomes smaller. The magnetic circuit forming members welded in this state to the arm are prone to easily separate from the arm, and the armature has only a short service life.

Faster printing speeds attained in recent years have increased the need for lightweight armatures. The arm of the lightweight armature is made as thin as possible to reduce the inertial momentum caused by the vibration. The arm and the magnetic circuit forming members of the armature are also being made smaller in size or miniaturized. The smaller size of the arm and magnetic circuit forming members makes them difficult to spot weld so that the connecting joint does not have sufficient strength to withstand the swing of the armature.

SUMMARY OF THE INVENTION

In view of the above problems with the related art, the present invention has an object of providing an armature manufacturing method for increasing the strength of the joint connecting an arm and magnetic circuit forming members.

The above object of the present invention is achieved by a novel armature manufacturing method.

The method of the present invention for manufacturing an armature containing an arm mounted with a printing wire, and magnetic circuit forming members attached to that arm comprises: a process for mounting magnetic circuit forming members on an arm with material having a high electrical resistance interposed between the arm and each magnetic circuit forming member; and a process for spot welding the arm and magnetic circuit forming members enclosing this electrically resistive material.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

An embodiment of the armature manufacturing method of the present invention is described next while referring to the accompanying drawings.

Figure 1:
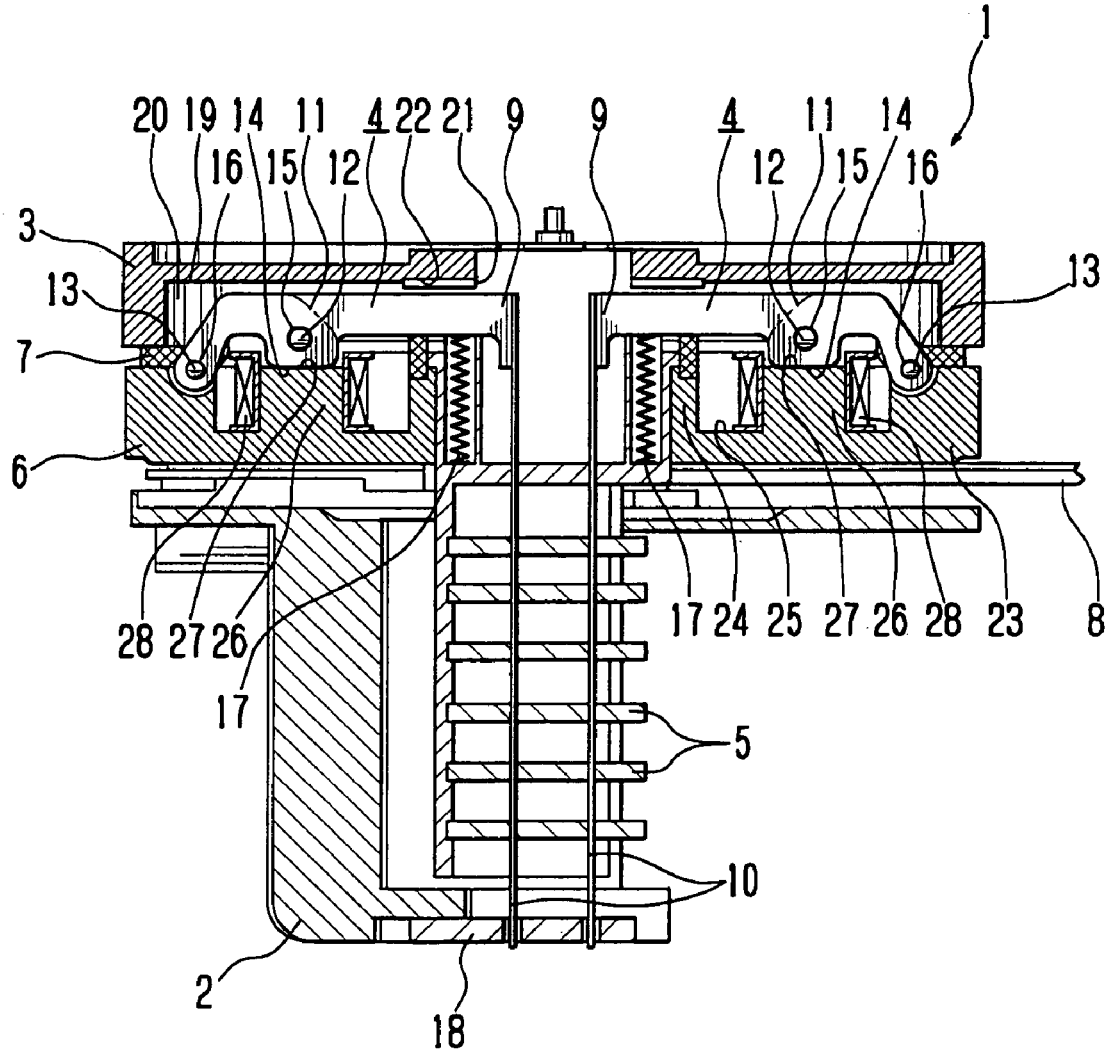
FIG. 1 is a longitudinal sectional view of a print head in a wire dot matrix printer containing armatures manufactured by an armature manufacturing method of an embodiment of the present invention.
Figure 2:
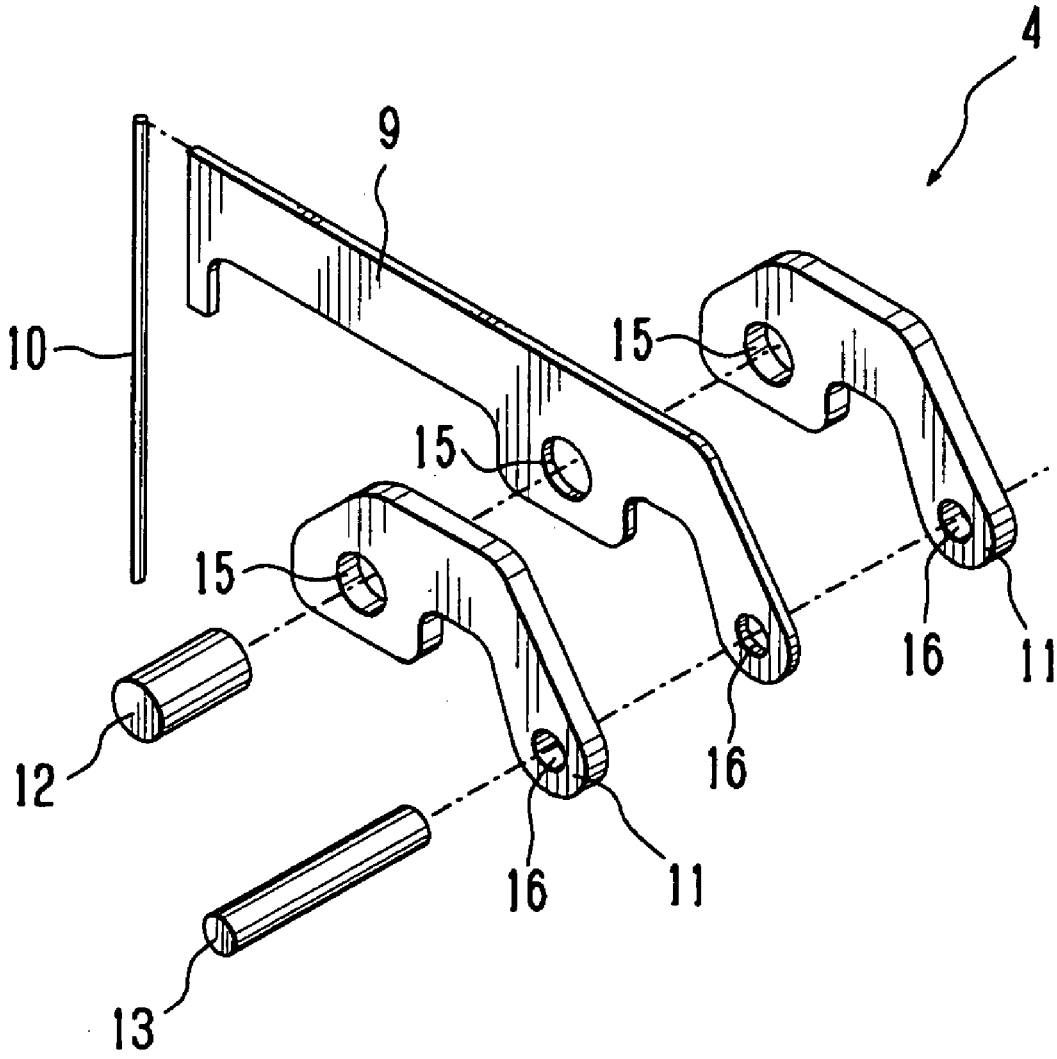
FIG. 2 is an exploded perspective view of an armature in the print head shown in FIG. 1.

Print Head 1 The overall structure of a print head 1 for a wire dot matrix printer is described while referring to FIG. 1 and FIG. 2. FIG. 1 is a longitudinal sectional view of the print head 1 in the wire dot matrix printer. FIG. 2 is an exploded perspective view of an armature 4 in the print head-1.

The print head 1 has a case formed by fastening a front case 2 and a rear case 3 together by set screws (not shown in drawing). The armatures 4, wire guides 5, a yoke 6, armature spacers 7 and a wiring board 8 are provided inside this print head 1 case.

The armature 4 contains a flat arm 9, a printing wire (hereinafter simply called "wire") 10 attached length-wise on the arm 9 (direction in which arm 9 extends) by brazing, magnetic circuit forming members 11 respectively welded to the opposite side surfaces in the thickness direction of the arm 9, a temporary fitting pin 12 for temporarily fastening together the arm 9 and the magnetic circuit forming members 11 for welding, and a pivot 13. Each magnetic circuit forming member 11 has a contact surface 14 corresponding to the middle section of the armature 4. The arm 9 and the magnetic circuit forming members 11 are formed with fitting holes 15 and end holes 16. The fitting pin 12 is pressed into the fitting holes 15. The pivot 13 is pressed into the end holes 16.

To enable high-speed printing, the arm 9 is formed of a carbon tool steel in a thickness for example of 0.20 mm. The magnetic circuit forming members 11 are formed for example of 1% Si silicon steel. The arm 9 and the magnetic circuit forming members 11 are processed for example by a carburizing process for surface hardening. The surfaces of the arm 9 and the magnetic circuit forming members 11 are coated with a thin layer of metal by plating, such as a nickel layer formed by nickel-plating to prevent corrosion and to improve capability for brazing The fitting pin 12 and the pivot 13 are also carburized and plated.

The armatures 4 are arranged on a surface of the yoke 6 extending radially from the axis of the yoke 6. The armatures 4 are supported for turning on the pivots 13 on the yoke 6 and are pushed in a direction away from the yoke 6 by pushing members 17 such as a coil spring. The wire 10 is moved toward and strikes a printing medium such as paper for printing when the armature 4 is turned from waiting position to printing position.

The wire guides 5 guides the wires 10 to slide so that the tips of the wires 10 strike the desired position of the print medium. The front case 2 is provided with a tip guide 18 for setting the tips of the wires 10 in a predetermined pattern and for guiding the wires 10 in a sliding movement.

The rear case 3 has a bottom wall 19 and a cylindrical side wall 20. A recess 22 is formed in a central section of the inner surface of the bottom wall 19. An annular armature stopper 21 formed of a metal is fitted into the recess 22. The armature 4 is pushed backward from the printing position toward the waiting position by the pushing member 17. The arm 9 of the armature 4 then comes in contact with the armature stopper 21 to stop the armature 4 at the waiting position. The armature stopper 21 has a function for defining the waiting position of the armature 4.

The armature spacers 7 support the pivots 13 of the armatures 4 for turning together with the yoke 6. The pivots 13 of the armatures 4 are therefore supported by the yoke 6 and the armature spacers 7. The wiring board 8 is installed with a control circuit for controlling the turning motion of the armatures 4 between the printing position and the waiting position. During printing the control circuit of the wiring board 8 selectively turns an armature 4.

The yoke 6 is formed of a magnetic material. The yoke 6 has an outer annular ridge 23, an inner annular ridge 24, a bottom wall 25, and a plurality of cores 26. The annular ridges 23 and 24 are concentric and have different respective diameters. The annular ridges 23 and 24 are integrated into a single piece by the bottom wall 25 set so as to seal one end along the axial center. The bottom wall 25 and the cores 26 are formed integrally in a single piece. The cores 26 are arranged in a circle in an annular space between the outer annular ridge 23 and the inner annular ridge 24. The annular ridges 23 and 24, and the cores 26 have the same radial thickness.

At one end along the axial center of the yoke 6 of each of the cores 26, each of pole surfaces 27 is formed facing the contact surfaces 14 of the magnetic circuit forming members 11 of the armatures 4. A coil 28 is wound around each core 26. The yoke 6 has electromagnets arranged in a circle, and each electromagnet is formed by winding the coil 28 around the core 26. Although all the coils 28 of this print head 1 are wound in the same direction, the print head 1 may have coils wound in different directions.

The coils 28 of the print head 1 are selectively energized to attract the corresponding armatures 4 magnetically to the cores 26. The armature 4 magnetically attracted to the core 26 turns on the pivot 13. The wire 10 attached to the armature 4 is moved from the waiting position to the printing position to strike paper resting against a platen (not shown in drawing) to print a dot through an ink ribbon (not shown in drawing). When the coil 28 is de-energized, the magnetic field collapses and the pushing member 17 returns the armature 4 to the waiting position where the armature 4 rests on the armature stopper 21.

Manufacturing Method of Armature 4

Figure 3:
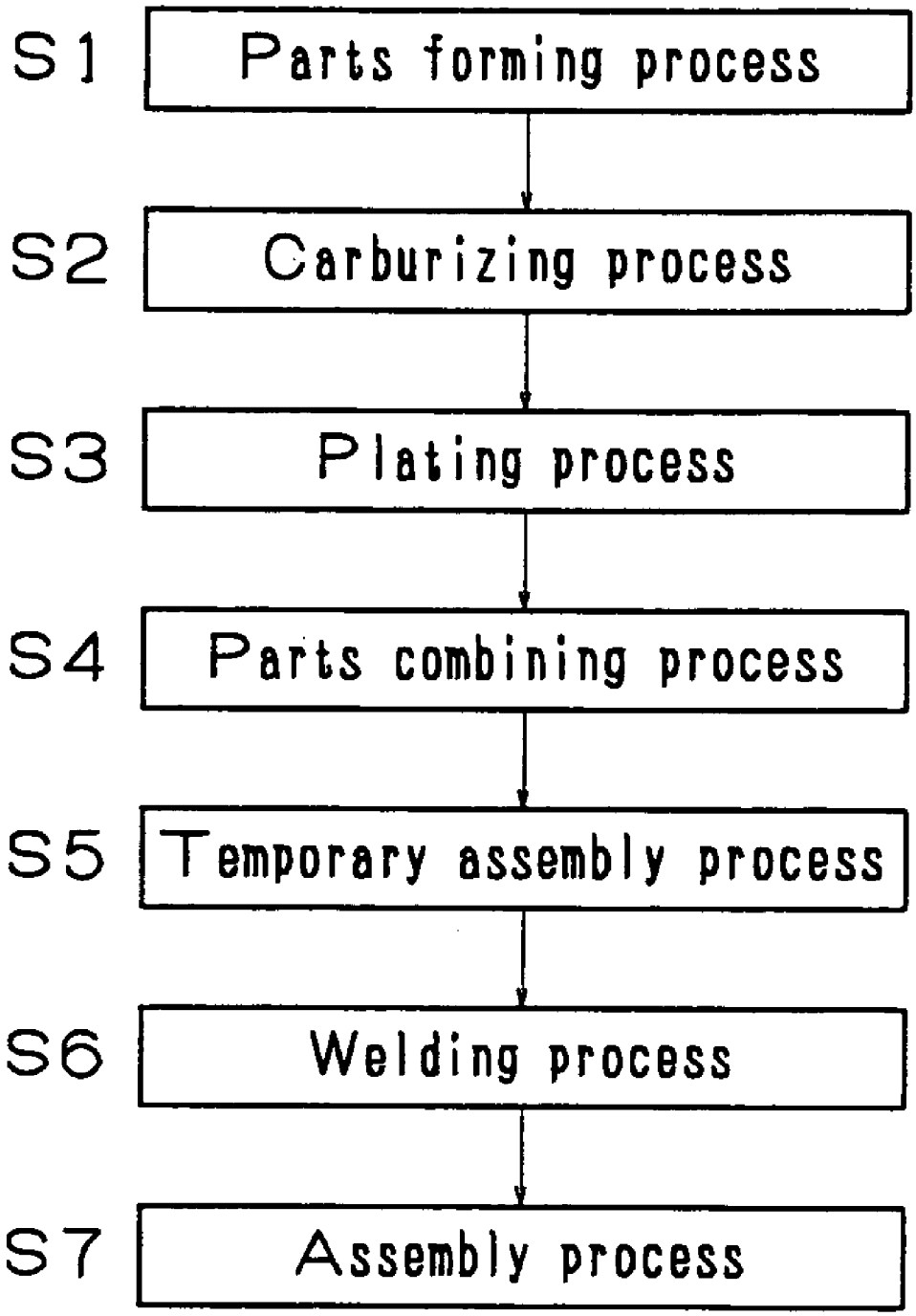
FIG. 3 is a flow chart showing the steps in the armature manufacturing method of the present invention.
Figures 4, 5:
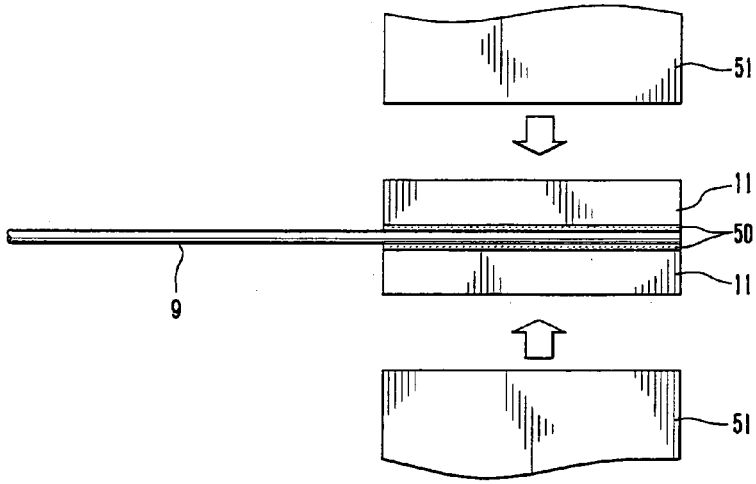
FIG. 4 is a drawing describing the armature manufacturing method of the present invention.
FIG. 5 is a table describing the effect of spot-welding conditions on the strength of a weld.

The method for manufacturing the armature 4 is next described while referring to FIG. 2 through FIG. 4. FIG. 3 is a flow chart showing the steps in the armature manufacturing method of the present invention. FIG. 4 is a drawing describing the armature manufacturing method of the present invention.

In FIG. 3, the armature manufacturing method includes a parts forming process (step S1) for forming the arm 9, the magnetic circuit forming members 11, the temporary fitting pin 12 and the pivot 13, a carburizing process (step S2) for carburizing the arm 9 and the magnetic circuit forming members 11. This method also includes a plating process (step S3) for plating the carburized arm 9 and the magnetic circuit forming members 11, as well as a parts combining process (step S4) for combining the arm 9 and the magnetic circuit forming members 11 with a resistive layer 50 of a resistive material having high electrical resistance interposed between the arm 9 and each magnetic circuit forming member 11. This method further includes a temporary assembly process (step S5) for temporarily joining the arm 9 and the magnetic circuit forming members 11 together by pressing the magnetic circuit forming members 11 against the opposite side surfaces of the arm 9 with the electrical resistive layers 50 interposed between the arm 9 and the magnetic circuit forming members 11. This method also includes a welding process (step S6) for attaching the magnetic circuit forming members 11 to the arm 9 by spot welding, and also includes an assembly process (step S7) for the arm 9, the magnetic circuit forming members 11 and the pivot 13. The wire 10 is attached to the arm 9 by brazing at a predetermined stage.

The parts forming process respectively forms the arm 9 and the magnetic circuit forming members 11 of different materials. The arm 9 is formed of carbon tool steel in a thickness of 0.20 mm. The magnetic circuit forming members 11 are formed of a 1% Si silicon steel. Materials of the arm 9 and the magnetic circuit forming members 11 are not limited to these material and dimensions. The temporary fitting pin 12 for example is an 0.80 mm diameter rod.

The carburizing process carburizes the arm 9, the magnetic circuit forming members 11, the temporary fitting pin 12 and the pivot 13 to increase the surface hardness of the arm 9, the magnetic circuit forming members 11, the temporary fitting pin 12 and the pivot 13.

The plating process plates the carburized arm 9, the magnetic circuit forming members 11, the temporary fitting pin 12 and the pivot 13 by a nickel electroplating process. Plating prevents the component parts from corrosion and improves capability for brazing. Since the concentration of electrical current onto un-plated parts is avoided, sufficient heat can be generated for joining the surfaces of the arm 10 and the magnetic circuit forming members 11 together.

The parts combining process forms the resistive layers 50 on the joining surfaces of the arm 9 or on the joining surfaces of the magnetic circuit forming members 11 such that the resistive layers 50 are sandwiched between the arm 9 and the magnetic circuit forming members 11 as shown in FIG. 4. The resistive layers 50 are formed of a material prepared by dispersing alumina powder in a binder. The resistive layer 50 is in this way formed between the arm 9 and each magnetic circuit forming member 11.

In the temporary assembly process, the temporary fitting pin 12 is pressed into the fitting holes 15 in the arm 9 and magnetic circuit forming members 11 in which the resistive layer 50 is interposed therebetween (FIG. 2), whereby temporarily assembly of the arm 9 and the magnetic circuit forming members 11 are performed. This process facilitates handling the assembly of the arm 9 and the magnetic circuit forming members 11, and facilitates attaching the magnetic circuit forming members 11 to the arm 9 by spot welding.

The welding process brings two electrodes 51 into contact with the magnetic circuit forming members 11 so as to press the magnetic circuit forming members 11 against the side surfaces of the arm 9 as shown in FIG. 4. A voltage is then applied across the electrodes 51 to pass current through the electrode 51, the magnetic circuit forming member 11, the arm 9, the magnetic circuit forming member 11 and the electrode 51 to fasten the magnetic circuit forming members 11 to the arm 9 by spot welding. The nuggets or in other words, the weld beads, are formed between the arm 9 and the magnetic circuit forming members 11. The arm 9 and the magnetic circuit forming members 11 are in this way firmly joined together.

In the assembly process, the pivot 13 is pressed into the end holes 16 of the arm 9 and the magnetic circuit forming members 11 (FIG. 2) to combine the spot-welded arm 9 to the magnetic circuit forming members 11 and complete the armature 4. The wire 10 is attached to the arm 9 by brazing at a predetermined timing.

The armature manufacturing method of the present invention interposes the resistive layers 50 between the arm 9 and the magnetic circuit forming members 11 to maintain satisfactory contact between the arm 9 and the magnetic circuit forming members 11, and to increase the electrical resistance along the welding current path. Heat is therefore generated in the surfaces joining the arm 9 and magnetic circuit forming members 11 and nuggets are formed in large areas. These large nuggets hold the arm 9 and the magnetic circuit forming members 11 together by high weld strength. Although the arm 9 and the magnetic circuit forming members 11 of the armature 4 are carburized and plated, the arm 9 and the magnetic circuit forming members 11 are held together by high weld strength. The armature 4 will not come apart and will have a long service life.

The nuggets formed by spot-welding the assembly of the arm 9 and the magnetic circuit forming members 11 with the resistive layers 50, as compared with those formed by spot-welding the assembly of the arm 9 and the magnetic circuit forming members 11 without the resistive layers 50, can be formed by a low welding current, are large, and have high weld strength. Thus, the assembly of the arm 9 and the magnetic circuit forming members 11 with the resistive layers 50 can be welded together by using a low welding current, which is effective in preventing the distortion of the arm 9 and the magnetic circuit forming members 11. Since the arm 9 and the magnetic circuit forming members 11 are not distorted, the pivot 13 can be smoothly pressed into the end holes 16 after spot welding the arm 9 and the magnetic circuit forming members 11 together.

The parts combining process of the armature manufacturing method of the present invention combines the arm 9 and the magnetic circuit forming members 11 such that the magnetic circuit forming members 11 are in contact with the respective side surfaces of the arm 9. The armature 4 having the magnetic circuit forming members 11 welded to the respective opposite side surfaces of the arm 9 is able to turn stably. Since the resistive layers 50 are sandwiched between the arm and the magnetic circuit forming members 11, the weld strength holding the arm 9 and the magnetic circuit forming members 11 of the armature 4 together can be increased.

The armature manufacturing method of the present invention includes a plating process for plating the arm 9 and the magnetic circuit forming members 11 prior to the parts combining process, so corrosion resistance and capability of brazing are improved. Nickel electroplating of the arm 9 and the magnetic circuit forming members 11 by the plating process surely improves the corrosion resistance of the arm 9 and the magnetic circuit forming members 11. The capability of brazing is also surely improved. Even though the arm 9 and-the magnetic circuit forming members 11 are plated, forming the resistive layers 50 between the arm 9 and the magnetic circuit forming members 11 allows welding the arm 9 and members 11 together at a high weld strength.

The arm 9 and the magnetic circuit forming members 11 have a high surface hardness since the armature manufacturing method of the present invention includes a carburizing process for carburizing the arm 9 and the magnetic circuit forming members 11 prior to the part combining process. Even though the arm 9 and the magnetic circuit forming members 11 are carburized, forming the resistive layers 50 between the arm 9 and members 11 allows holding the arm 9 and the magnetic circuit forming members 11 together with a high weld strength 1.

Since the armature manufacturing method of the present invention includes a parts forming process for forming the arm 9 and the magnetic circuit forming members 11 respectively of different materials prior to the parts combining process, an arm 9 having high strength can be formed. The parts forming process respectively forms the arm 9 and magnetic circuit forming members 11 of different materials such as carbon tool steel and silicon steel so that an arm 9 having high strength can be easily made. Although the arm 9 and the magnetic circuit forming members 11 are formed of respectively different materials, the arm 9 and the magnetic circuit forming members 11 of the armature 4 can be held together with a high weld strength by forming the resistive layers 50 between the arm 9 and the magnetic circuit forming members 11.

The armature manufacturing method of the present invention includes a parts forming process that forms the fitting holes 15 in the arm 9 and the magnetic circuit forming members 11 prior to the parts combining process. The armature manufacturing method also is comprised of a temporary assembly process that presses the fitting pin 12 into the fitting holes 15 of the arm 9 and the magnetic circuit forming members 11 after the parts combining process and before the welding process. Because of the parts forming process and temporary assembly process, the arm 9 and the magnetic circuit forming members 11 can be easily welded together by spot welding.

Since the armature manufacturing method of the present invention includes a plating process for plating the arm 9, the magnetic circuit forming members 11 and the fitting pin 12 prior to the parts combining process, the armature 4 has improved corrosion resistance, and capability of brazing to the wire 10 is improved. Further, heat sufficient for welding can be generated in the joining surfaces since the spot-welding current is not concentrated on un-plated parts.

The armatures 4 were manufactured by the armature manufacturing method of the present invention and also by a conventional armature manufacturing method in a comparative example. The strength of respective welds and size of the nuggets were examined and compared. The armature manufacturing method of the present invention differs from the conventional armature manufacturing method in that resistive layers 50 are formed between the arm 9 and the magnetic circuit forming members 11. The armature manufacturing method in the comparative example does not contain layers corresponding to the resistive layers 50 between the arm 9 and the magnetic circuit forming members 11.

The arms 9 and magnetic circuit forming members 11 for manufacturing the armatures 4 are described next.

Arm 9

A work piece for forming an arm 9 was formed by cutting a 0.20 mm thick sheet of carbon tool steel (SK5, JIS) with a hardness of Hv 580. The surface of the work piece was coated with a 5 μm thick nickel film by electroplating (Ep-Fe/E-Ni). The nickel film formed by the electroplating has a high melting point of 1400° C. Spot welding is therefore difficult to use on this work piece since the base material might deform. So forming high strength welds on this material is difficult.

Magnetic Circuit Forming Member 11

A work piece for forming a magnetic circuit forming member 11 was formed by cutting a 0.6 mm thick sheet of 1% Si silicon steel. The surface of the work piece was coated with 5 μm thick nickel film by electroplating (Ep-Fe/E-Ni). The magnetic circuit forming member 11 was carburized for surface hardening. The depth of the carburization (hardening depth) was 0.10 mm.

Figure 6A:
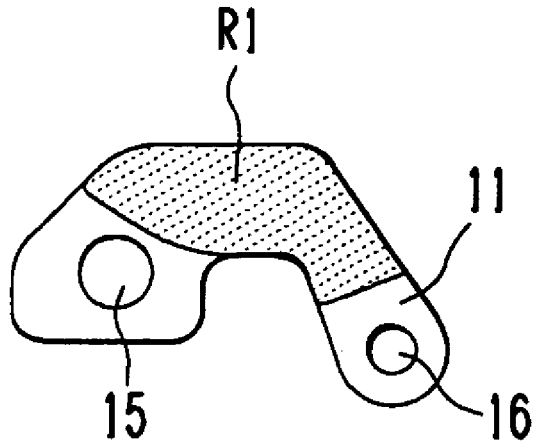
FIG. 6A is a schematic plan view of a magnetic circuit forming member, showing a region with a nugget formed by the armature manufacturing method of the present invention.
Figure 6B:
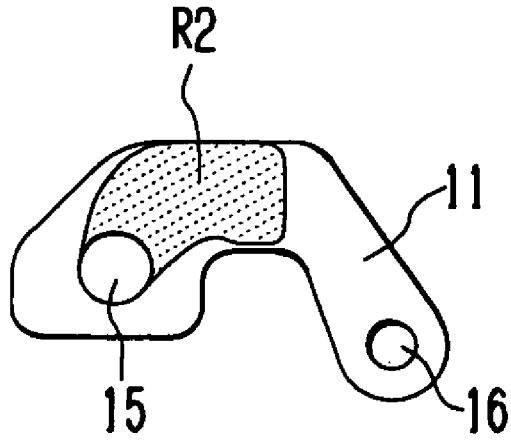
FIG. 6B is a schematic plan view of a magnetic circuit forming member, showing a region with a nugget formed by a (conventional) armature manufacturing method in a comparative example.

Armatures 4 were manufactured by assembling the arms 9 and the magnetic circuit forming members 11 by the armature manufacturing method of the present invention. Armatures 4 were also made by the armature manufacturing method of comparative example. The respective strength of welds formed by spot welding and the size of nugget forming regions were measured. The measured strength of the welds formed by spot welding is shown in FIG. 5. The size of the nugget forming regions is shown in FIG. 6A and FIG. 6B.

The spot welding by the manufacturing method of the armature 4 of the present invention was compared with the armature 4 in the comparative example. The spot welding of the arm 9 and the magnetic circuit forming member 11 was performed under the spot welding conditions (present example and comparative example) shown in FIG. 5.

FIG. 5 shows conditions for welding the arm 9 and the magnetic circuit forming members 11 by the welding processes of the method of the present invention and by the conventional armature manufacturing method. FIG. 5 also shows the respective measured weld strengths. FIG. 6A and FIG. 6B show respective side plan views of regions where a nugget was formed by the welding processes of the present invention, and by the conventional armature manufacturing method.

As shown in FIG. 5, the weld formed in the armature 4 manufactured by the method of the present invention (hereinafter referred to as "armature of the invention") has a weld strength of 5.8 kgf·cm. However, the weld formed in the armature 4 manufactured by the conventional method (hereinafter referred to as "armature in comparative example") has a weld strength of 5.5 kgf·cm. The weld strength of the weld in the armature in example is therefore about 5.5% higher than the weld in the comparative example. The weld strength of the weld in the armature of the invention was therefore confirmed to be higher than the comparative example. Also confirmed was that the arm 9 and the magnetic circuit forming members 11 of the armature 4 in the invention can be welded together using a low welding current. FIG. 6A and FIG. 6B also clearly show that a nugget forming region R1 in the armature of the invention is about 1.5 times larger than the nugget forming region R2 in the comparative example. The nugget forming region R1 (of the invention) was therefore larger than the nugget forming region R2 (of the conventional art).

The armature manufacturing method of the present invention with resistive layers 50 formed between the arm 9 and the magnetic circuit forming members 11 can form a nugget in the nugget forming region R1 larger than the nugget forming region R2. The method of the invention also maintains the arm 9 and the magnetic circuit forming members 11 at a high weld strength even though the arm 9 and the magnetic circuit forming members 11 are coated with a nickel film by electroplating. The armature manufacturing method of the present invention also allows welding the arm 9 and magnetic circuit forming members 11 together with a welding current lower than that required by the comparative method that does not contain the resistive layers 50.

Obviously, numerous modifications and variations of the present invention are possible in light of the above teachings. It is therefore to be understood that within the scope of appended claims, the invention may be practiced otherwise than as specifically described herein.

What is claimed is:

1. A manufacturing method for an armature including an arm holding a printing wire, and magnetic circuit forming members attached to the arm, the method comprising:

placing the magnetic circuit forming members on the arm with a resistive layer of a resistive material sandwiched between the arm and each of the magnetic circuit forming members, wherein the resistive layers increase an electric resistance between the arm and each of the magnetic circuit forming members; and welding together the arm and the magnetic circuit forming members, with the resistive layers sandwiched between the arm and the magnetic circuit forming members, by spot welding.

2. The manufacturing method according to claim 1, wherein the magnetic circuit forming members are mounted on the arm so as to be held by respective opposite side surfaces of the arm.

3. The manufacturing method according to claim 1 further comprising plating the arm and the magnetic circuit forming members before placing the magnetic circuit forming members on the arm.

4. The manufacturing method according to claim 3, wherein the plating comprises depositing a nickel film on the arm and the magnetic circuit forming members by electroplating.

5. The manufacturing method according to claim 1, further comprising carburizing the arm and the magnetic circuit forming members before placing the magnetic circuit forming members on the arm.

6. The manufacturing method according to claim 1, further comprising forming the arm and the magnetic circuit forming members of different materials.

7. The manufacturing method according to claim 6, wherein the arm is formed of a carbon tool steel, and the magnetic circuit forming members are formed of a silicon steel.

8. The manufacturing method according to claim 1, further comprising:

forming through holes that are used as fitting holes in the arm and the magnetic circuit forming members before placing the magnetic circuit forming members on the arm; and temporarily assembling the arm and the magnetic circuit forming members by pressing a fitting pin into the fitting holes after placing the magnetic circuit forming members on the arm and before the welding.

9. The manufacturing method according to claim 8, further comprising plating the arm, the magnetic circuit forming members, and the fitting pin before placing the magnetic circuit forming members on the arm.

* * * * *